US009526963B2

(12) United States Patent
Williams

(10) Patent No.: US 9,526,963 B2
(45) **Date of Patent: *Dec. 27, 2016**

(54) METHOD OF ENHANCING A PARTICIPANT'S PERFORMANCE IN A SPORTING ACTIVITY

(76) Inventor: Taly Williams, Los Angeles, CA (US)

( * ) Notice: Subject to any disclaimer, the term of this patent is extended or adjusted under 35 U.S.C. 154(b) by 1154 days.

This patent is subject to a terminal disclaimer.

(21) Appl. No.: 12/819,941

(22) Filed: Jun. 21, 2010

(65) Prior Publication Data

US 2011/0014991 A1 Jan. 20, 2011

Related U.S. Application Data

(63) Continuation of application No. 11/626,799, filed on Jan. 24, 2007, now Pat. No. 7,740,544.

(60) Provisional application No. 60/762,363, filed on Jan. 25, 2006, provisional application No. 60/765,637, filed on Feb. 6, 2006.

(51) Int. Cl.
*A63B 69/36* (2006.01)

(52) U.S. Cl.
CPC ..... *A63B 69/3608* (2013.01); *A63B 69/3641* (2013.01); *A63B 69/3623* (2013.01); *A63B 69/3676* (2013.01); *A63B 2207/02* (2013.01); *A63B 2209/10* (2013.01); *A63B 2210/58* (2013.01); *A63B 2225/09* (2013.01); *A63B 2230/04* (2013.01); *A63B 2230/06* (2013.01); *A63B 2230/30* (2013.01)

(58) Field of Classification Search
USPC ..... 473/201, 205, 207, 212–217, 219–221,473/223, 226–229, 256, 266–269, 276, 277,473/409, 422
See application file for complete search history.

(56) References Cited

U.S. PATENT DOCUMENTS

| | | | | |
|---|---|---|---|---|
| 1,169,188 | A | 1/1916 | Peck | |
| 1,962,256 | A | 6/1934 | Nelson et al. | |
| 2,482,015 | A | 9/1949 | McConnell | |
| 3,109,244 | A | 11/1963 | Trifaro et al. | |
| 3,437,339 | A | 4/1969 | Starck | |
| 4,022,467 | A | 5/1977 | Ruess | |
| 4,257,607 | A | 3/1981 | Nedwick | |
| 4,298,201 | A | 11/1981 | Palinkas | |
| 4,456,257 | A | 6/1984 | Perkins | |
| 4,815,743 | A | 3/1989 | Meeker et al. | |
| 4,878,673 | A | 11/1989 | Pollard | |
| 5,152,532 | A | 10/1992 | Rouse | |
| 5,156,399 | A * | 10/1992 | Gauer | 473/205 |
| D336,673 | S | 6/1993 | Ohly et al. | |

(Continued)

*Primary Examiner* — Nini Legesse
(74) *Attorney, Agent, or Firm* — Knobbe, Martens, Olson & Bear, LLP

(57) ABSTRACT

According to one aspect of the present invention, a method of improving a participant's ability to move an object toward a desired target through athletic movement is provided. The method comprises establishing a point of focus that is positioned outward from a participant's body. The method further comprises instructing the participant to continuously move the point of focus through one or more series of bodily movements within the field of vision of the participant. By shifting his or her emphasis on continuously moving the point of focus, the participant is able to improve focus and concentration, and eliminate the stress and anxiety associated with executing an athletic movement. The method also naturally triggers correct body mechanics, including the proper sequential release of the participant's joints.

6 Claims, 12 Drawing Sheets

(56) References Cited

U.S. PATENT DOCUMENTS

| | | | | | |
|---|---|---|---|---|---|
| 5,253,870 | A | | 10/1993 | Bedney | |
| 5,269,528 | A | | 12/1993 | McCardle, Jr. | |
| 5,368,042 | A | * | 11/1994 | O'Neal et al. | 600/546 |
| 5,397,121 | A | * | 3/1995 | Gipson et al. | 473/215 |
| 5,474,299 | A | | 12/1995 | Romano | |
| 5,529,306 | A | | 6/1996 | Staats et al. | |
| 5,544,888 | A | | 8/1996 | Pellegrini | |
| 5,588,919 | A | | 12/1996 | Nakamura | |
| 5,643,097 | A | | 7/1997 | Bechler et al. | |
| 5,658,203 | A | | 8/1997 | Shub | |
| 5,665,006 | A | | 9/1997 | Pellegrini | |
| 5,685,787 | A | | 11/1997 | Kogut | |
| 5,823,886 | A | | 10/1998 | Murray | |
| 5,890,968 | A | * | 4/1999 | Mingo | 473/207 |
| 5,919,097 | A | * | 7/1999 | Cole | 473/212 |
| 5,954,598 | A | * | 9/1999 | Carlson | 473/458 |
| 6,165,079 | A | | 12/2000 | Czaja | |
| 6,390,823 | B1 | | 5/2002 | Wesenhagen | |
| 6,471,598 | B2 | | 10/2002 | Takase | |
| 6,487,906 | B1 | * | 12/2002 | Hock | 73/379.01 |
| 6,582,318 | B1 | * | 6/2003 | Halfacre | 473/215 |
| 6,939,245 | B1 | * | 9/2005 | Mullarkey | 473/268 |
| 7,455,595 | B1 | | 11/2008 | Gibbons et al. | |
| 7,740,544 | B2 | | 6/2010 | Williams | |
| 8,038,549 | B2 | * | 10/2011 | Vann | 473/450 |
| 2001/0021674 | A1 | | 9/2001 | Takase | |
| 2002/0039930 | A1 | * | 4/2002 | Smith | 473/215 |
| 2006/0128538 | A1 | * | 6/2006 | Sato et al. | 482/112 |
| 2006/0142128 | A1 | * | 6/2006 | Sato | 482/112 |

* cited by examiner

METHOD OF ENHANCING A PARTICIPANT'S PERFORMANCE IN A SPORTING ACTIVITY

CROSS-REFERENCE TO RELATED APPLICATIONS

This application is a continuation of co-pending U.S. patent application Ser. No. 11/626,799, filed Jan. 24, 2007, which claims the priority benefit under 35 U.S.C. §119(e) of U.S. Provisional Application No. 60/762,363, filed Jan. 25, 2006 and U.S. Provisional Application No. 60/765,637, filed Feb. 6, 2006, the entireties of all of which are hereby incorporated by reference herein.

BACKGROUND OF THE INVENTION

Field of the Invention

This invention relates generally to a method of improving a person's ability to perform in a sporting activity and, in particular, to a method of improving a person's ability to move an object toward a desired target through athletic movement.

Description of the Related Art

Numerous training devices exist that attempt to improve a person's performance related to a sporting activity such as golf. A number of such devices are secured to the golf club itself to teach the golfer the precise desired position of the golf club during the golf stroke. Other aids comprise ersatz golf clubs or other devices gripped by the golfer which are swung by the golfer during practice to try to "groove" a proper swing during practice, that can hopefully be recreated during a round of golf.

A number of devices attempt to ensure that a person's body positioning is proper. For example, some devices are designed to show undesirable movement in a golfer's head during a golf swing. In addition, other devices attempt to ensure that a person's wrists, spine, shoulders, or feet are properly situated when performing a golf swing.

A number of other sport training devices are geared toward improving a person's performance by focusing on the person's body mechanics during the execution of the particular movement. For example, some devices alert the user if he or she is not following a desired motion. Other devices even physically guide or restrict portions of the user's body to ensure proper bodily positioning and movement. Finally, some devices offer indicators that the participant may intermittently use as a guide to ensure proper body alignment or mechanics.

Unfortunately, by forcing the user to focus on his or her alignment, positioning and body mechanics or the precise position of the golf club, these prior training devices and methods impose a lot of stress and anxiety on the user, and often cause the user to revert to his or her bad habits under pressure. Consequently, these devices and methods are generally ill-suited for helping a participant in a sporting activity achieve the necessary concentration and focus required to consistently and confidently execute a particular bodily motion associated with a sporting activity. This is especially true for sports that involve contact or a collision point, as such contact creates tension and interferes with the participant's natural body movement.

SUMMARY OF THE INVENTION

According to one embodiment, a method of improving the ability of a user to move an object toward a desired target through athletic movement is provided. The method comprises establishing a point of focus that is positioned outward from a user's body. The method further comprises continuously moving the point of focus through at least a portion of a back movement, a forward movement ending upon a completion of contact position and at least a portion of a follow-through movement so that the point of focus is substantially continuously within the field of vision of the user.

Desirably, in some embodiments, the method comprises moving the point of focus through a majority of a back movement, a forward movement ending upon a completion of contact position and a majority of a follow-through movement. Desirably, this movement of the point of focus is continuous. More desirably, in some embodiments, the method comprises continuously moving the point of focus through a substantially entire back movement, a forward movement ending upon a completion of contact position and a substantially entire follow-through movement.

In one embodiment, the point of focus is moved in a substantially circular motion. In one embodiment, the method further comprises a device that establishes the point of focus, but is not secured to a golf club or gripped by a user's hands. In one embodiment, the point of focus is associated with the position of the user's forearm. In one embodiment, the point of focus is substantially parallel to the user's forearm. In one embodiment, the point of focus is moved substantially within a plane.

In one embodiment, the point of focus is associated with the position of the user's shoulder. In one embodiment, the continuous movement of the point of focus results in continuous movement of the user's shoulders. In one embodiment, the method further comprises holding an implement for contacting an object to be moved. In one embodiment, the method comprises holding a golf club. In one embodiment, the method comprises holding a baseball bat. In one embodiment, the back movement, forward movement and follow-through comprise a golf swing. In one embodiment, the method comprises holding a baseball bat. In one embodiment, the back movement, forward movement and follow-through comprise a golf putt.

In one embodiment, an aide for teaching an athletic movement is disclosed. The aide comprises a body and at least one fastener configured to releasably secure the aide to the user's forearm. The aide further comprises a target that defines a point of focus in relation to the body so that the point of focus has a substantially constant position with respect to the forearm of the user. In one embodiment, the aide further comprises an adjustable wand that connects the body to the point of focus. In one embodiment, the point of focus is defined by a ball.

BRIEF DESCRIPTION OF THE DRAWINGS

The preferred embodiments, illustrating all its features, will now be discussed in detail. The drawings include the following Figures, with like numerals indicating like parts.

DETAILED DESCRIPTION OF THE PREFERRED EMBODIMENTS

Figure 1:
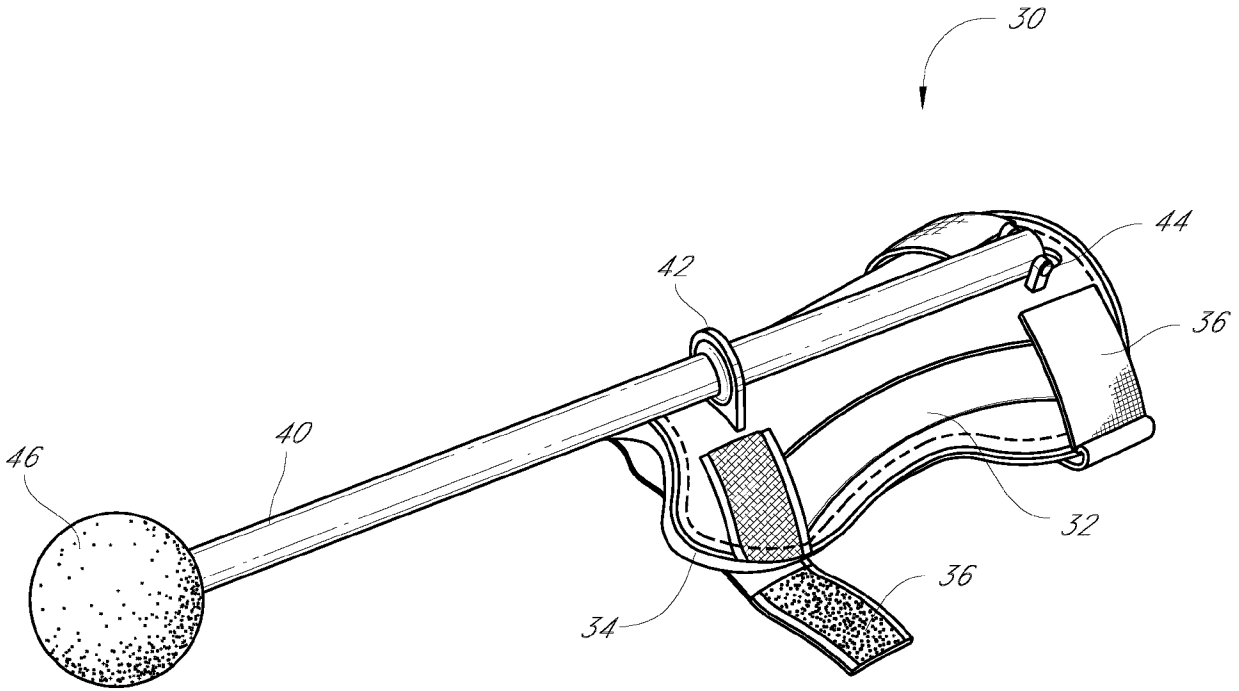
FIG. 1 shows a perspective view of one embodiment of a device used to establish a point of focus.

In some embodiments, a method of improving a user's ability to move an object toward a desired target is disclosed. In general, a user begins by continuously moving a point of focus through a portion of a back movement. The user continues to move the point of focus through a forward movement that results in the completion of a contact position. The user completes the continuous movement with a portion of a follow-through movement. More specifically, in some embodiments involving a striking movement, the majority of the forward movement does not involve contact or the release of contact. The contact or release of contact occurs towards the conclusion of the forward movement and is immediately followed by a follow-through movement. For example, in one embodiment of a golf swing, a golfer begins by continuously moving the point of focus through a portion of his or her backswing. The golfer then continuously moves the point of focus in his or her downswing, which concludes with the golf club striking the golf ball. The golfer continues to move the point of focus as part of the follow-through after contact with the golf ball has occurred In some embodiments, a method of improving the ability of a user to perform a golf swing is disclosed. In order to do so, some embodiments comprise establishing a point of focus and having a user continuously move that point of focus during the various stages of a golf swing (e.g., backswing, downswing, follow-through, etc.). In some embodiments, the point of focus is positioned in space, outward from the golfer's body, using a device that attaches to the golfer's forearm. By focusing on moving the point of focus, the golfer improves his or her focus and concentration, thereby increasing confidence and trust with respect to executing the golf swing. At the same time, the user is able to lessen or eliminate the stress and anxiety that accompany the swinging of a golf club. Thus, the golfer is able to improve his or her performance by shifting his or her focus to a secondary point of reference and away from the detailed body mechanics related to properly swinging a golf club. Desirably, this point of focus also allows the golfer to focus on the point of focus rather than the position of the golf club itself.

In some embodiments, the user may choose to visually follow the point of focus throughout the entire bodily movement (e.g., golf swing). In another embodiment, the user may instead choose to focus on some other object (e.g., the golf ball) and only partially view the point of focus during the movement (e.g., using his or her peripheral vision). In yet another embodiment, there is no physical point of focus that the user can actually see. Therefore, the user focuses on a point of focus only in a mental sense. In fact, these different embodiments may relate to different training stages. For example, a novice may feel more comfortable actually viewing the point of focus throughout the entire motion, whereas, one with more experience may not need to physically view the point of focus at all.

Figure 2:
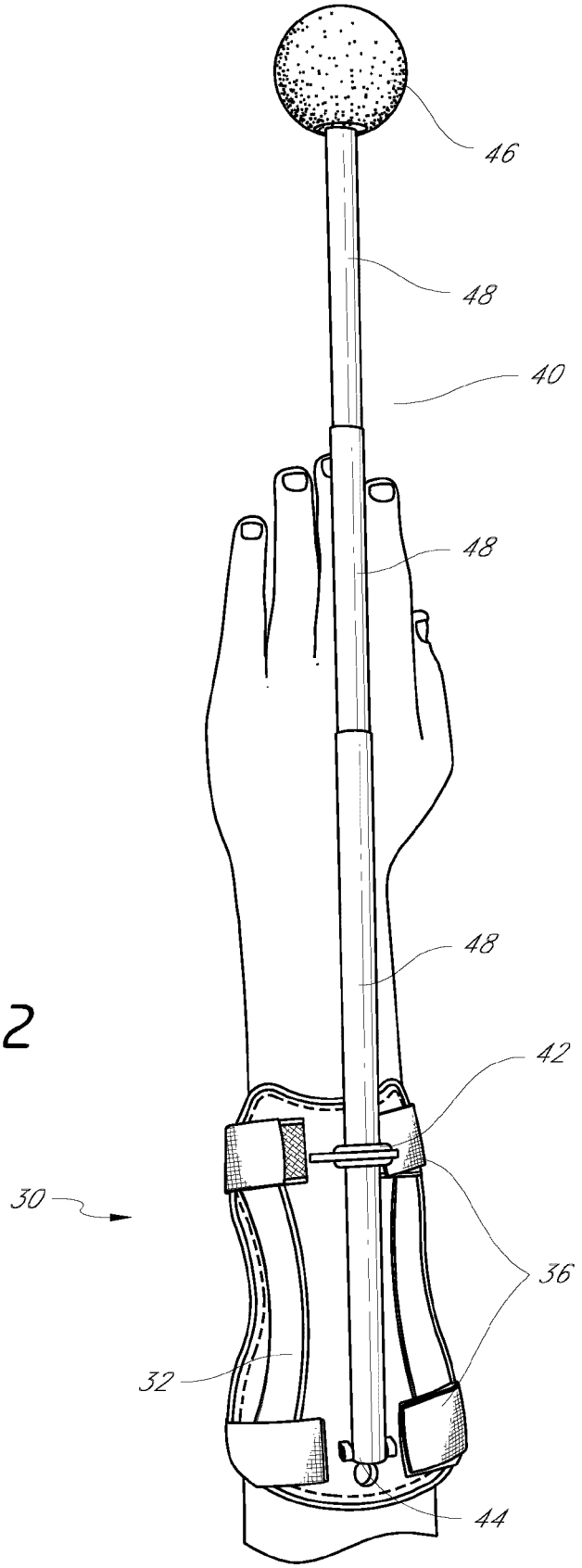
FIG. 2 shows a perspective view of the embodiment of the device of FIG. 1, worn on a user's left forearm.

FIG. 1 illustrates one embodiment of a training aide or device 30 that is used to establish a point of focus in a position outwardly away from the user's body. In a preferred embodiment, the device 30 may comprise a target 46 defining a point of focus, a rigid or semi rigid cuff 32 and an elongated member 40 that connects the cuff 32 to the target 46. As shown in FIG. 2, in one embodiment, the device 30 may be secured to the user's forearm using one or more nonadjustable or adjustable connectors, such as straps 36.

In some embodiments, the target 46 defining the point of focus may be tangible. For example, in a preferred embodiment, as shown in FIG. 1, the target 46 may comprise a bright-colored, spherical, foam object. A bright color, such as, for example, red, and the spherical shape facilitate the tracking of the target 46 by the golfer during the swing, especially when the golfer is not looking at the target 46 directly. Of course, the target 46 may have any of a variety of shapes and may be constructed of any of a variety of materials. Desirably, projection of the target 46 onto a plane defines an image area large enough for the golfer to easily see throughout the swing. Desirably, the area is at least 1 square inch, and more preferably at least 2 square inches. Alternatively, in one embodiment, the target 46 defining a point of focus may simply be much smaller, such as the distal end of the elongated member 40.

In some embodiments, the target 46 may not be a tangible object. For example, in one embodiment, the target 46 may comprise a light that projects a visible image. In other embodiments, the target 46 may comprise a holographic image projected outwardly away from the user's body. The projecting means for the image may be situated directly on the user's body or on a device that is attached to the user's body. In other embodiments, the user may require the use of special glasses or some other means to view the target 46 defining the point of focus. In yet other embodiments, the point of focus may be virtual. For example, a point of focus may exist strictly within the mind of the user. One situation in which this is likely to occur is where a participant has previously used a method that employs a tangible target defining a point of focus. Thus, in such embodiments the point of focus may exist within the mind of the user based on the user's previous recollection of a tangible and/or physical target. The device 30 of the illustrated embodiment is advantageous, however, in that it is reliable, inexpensive and simple to manufacture and use.

In some embodiments, the elongated member 40 is hollow. Desirably, the elongated member defines a constant length during the swing. In a preferred embodiment, however, the elongated member 40 is further provided with telescoping means to permit the user to vary the distance between the cuff 32 and the target 46 defining a point of focus to accommodate different user sizes and preferences. This also facilitates transportation and storage of the device 30. In one embodiment, the elongated member is long enough to visually enable a golfer to practice a golf swing without using a golf club. In one embodiment, the elongated member 40 comprises a lightweight aluminum material. However, the elongated member 40 may be constructed from any of a number of rigid or semi-rigid materials. In a preferred embodiment, as shown in FIG. 2, the target 46 defining a point of focus is attached to the distal end of the elongated member 40 comprised of a series of telescoping hollow tubes 48. Of course, those of skill in the art will recognize that the target 46 defining a point of focus may be attached at various locations along the elongated member 40, more or less proximal to the cuff 32. In addition, the target 46 defining a point of focus, may be attached to the elongated member 40 using any of a variety of connections (e.g., glued, welded, threaded, bolted, snap fit, other mechanical attachment means, etc.). In some embodiments, the target 46 defining a point of focus may be quickly detached and reattached, thus allowing the user to easily customize the device 30 according to his or her taste.

In some embodiments, as illustrated in FIG. 1, the elongated member 40 is attached to the cuff 32 at two places 42, 44. Other embodiments may use more or fewer attachment locations. In one embodiment, the lower connection 44 may be hinged to permit the elongated member 40 to rotate within a limited range relative to the cuff 32 and the user's forearm. In order to permit the elongated member 40 to rotate, the upper connection 42 may be designed to support the elongated member 40 at a particular distance away from the surface of the cuff 32. The hinged connection also ensures that the elongated member 40 does not interfere with the user's hands or other body part during use. Of course, it is apparent to those of skill in the art that different attachment means may be used to connect the elongated member 40 to the cuff 32.

As illustrated in FIG. 2, in a preferred embodiment, the device 30 is attached to the user's forearm using two adjustable straps 36. Of course, those of skill in the art will recognize that more or fewer straps 36 may be used. In some embodiments, the straps 36 are comprised of a flexible Velcro material, allowing the user to easily put on and remove the device 30. In some embodiments, the straps 36 may be constructed of different materials or may even be substituted altogether by some other means of securing the device 30 to the user. The securing means may also be configured to further ensure that the device 30 does not move relative to the user's forearm, or other body part to which the device 30 is attached, during use. In some embodiments, the device 30 includes a padded portion 34 that interfaces with the user to provide added comfort to the user. In a preferred embodiment, the padded portion 34 may comprise a soft rubber material (e.g., neoprene). In one embodiment, the padded portion 34 may be designed to better absorb body sweat or other moisture.

In the embodiment shown in FIG. 2, the device 30 is secured to the user's forearm. Thus, the location of the point of focus is associated with and, desirably substantially determined by, the position of the user's forearm. In a preferred embodiment, the device 30 is attached to the upper portion of the user's forearm (e.g., between the elbow and the wrist of the user), near the elbow, to ensure that the device 30 moves independently of the lower forearm and wrists. However, depending on the specific sporting activity and bodily movement involved, embodiments of the device 30 may be configured to be attached to other parts of the user's body (e.g., the upper arm between the shoulder and elbow of the user, the upper leg between the hip and knee of the user, etc.). For example, in some embodiments, a device 30 for use with respect to improving a user's kicking motion may be attached to the user's upper leg. In addition, those of skill in the art will recognize that the exact method of positioning the point of focus in a location outward from a user's body can be varied, so long as the point of focus is substantially within the field of vision of the user and can be continuously moved in connection with the particular bodily activity being performed.

In some embodiments, the point of focus is moved in a substantially circular pattern while performing a sporting activity. FIGS. 3B, 4B, 5B, 6B and 9B depict, in a time sequential manner, one embodiment of the method in use during the execution of a golf swing. In the illustrated embodiment, a device 30 having a target 46 defining a point of focus is situated on the golfer's forearm. In one embodiment, the right-handed golfer positions the device 30 on his or her left forearm in such a way that the elongated member 40 to which the target 46 defining a point of focus attaches is substantially parallel with the adjacent forearm. In a preferred embodiment, the elongated member 40 of the device should be substantially aligned with the backside of the golfer's forearm such that the golfer cannot see the elongated member 40 or the target 46 defining a point of focus when the golfer places his or her open palm in front of his or her face. When extended in the position shown in FIG. 2, the distance between the point of focus and the cuff desirably does not vary during use. As discussed above, in some embodiments, the golfer may be able to adjust the distance between the target 46 defining a point of focus and him or herself. For example, in the embodiments illustrated in FIGS. 3B, 4B, 5B, 6B and 9B, the device 30 is equipped with a telescoping elongated member 40, which permits the distance between the point of focus and the golfer's forearm to be easily varied.

Figure 3B:
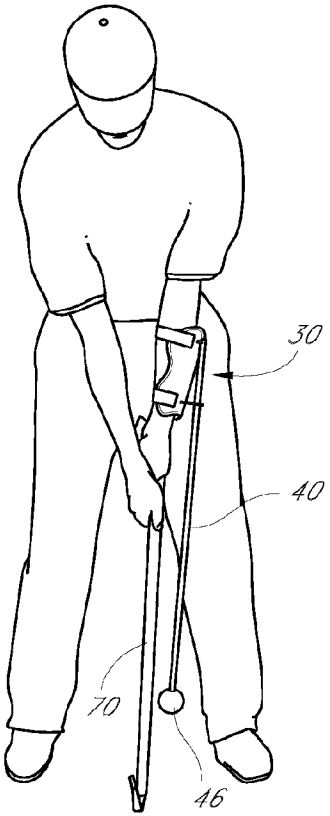
FIG. 3B shows a perspective front view of a golfer using one embodiment of the method at the initial address position of a golf swing.
Figure 4B:
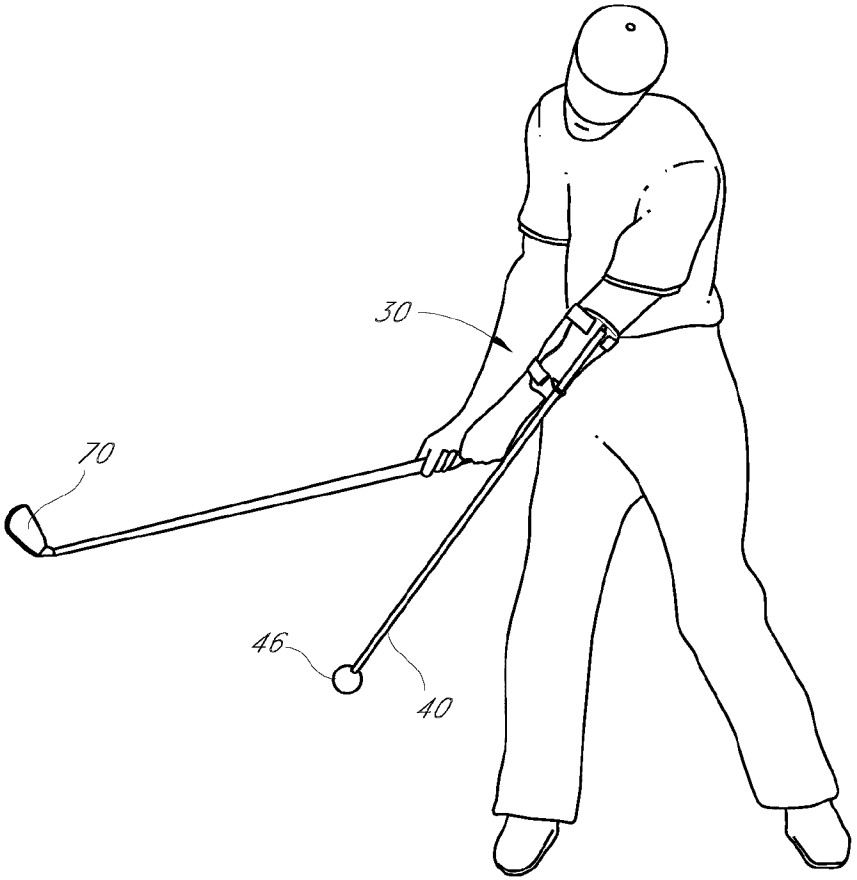
FIG. 4B shows a perspective front view of a golfer using one embodiment of the method during the backswing portion of a golf swing.
Figure 5B:
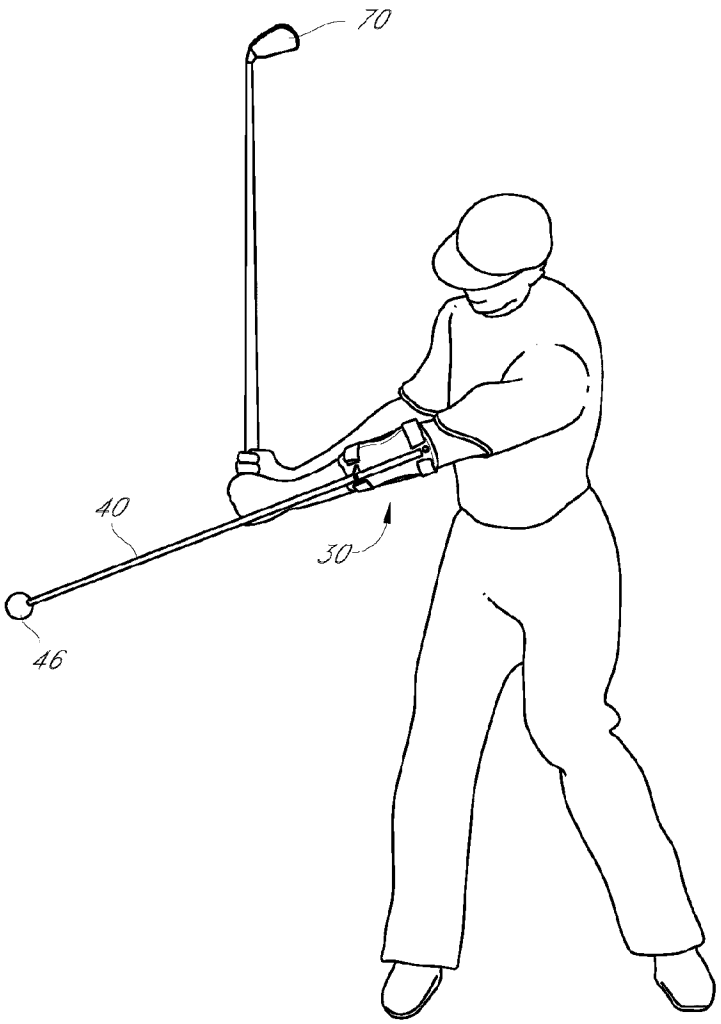
FIG. 5B shows a perspective front view of a golfer using one embodiment of the method during the backswing portion of a golf swing.
Figure 6B:
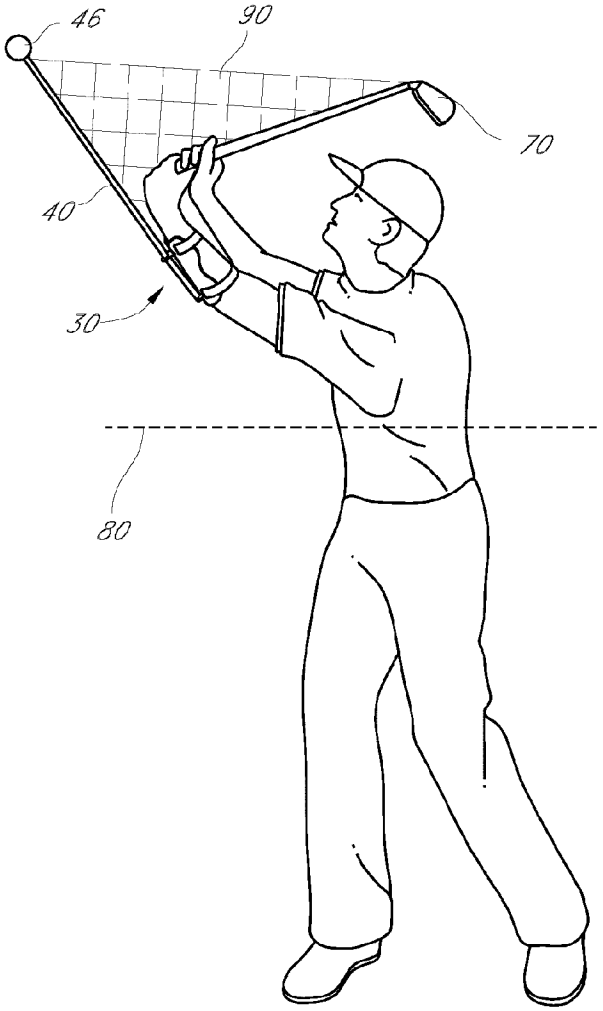
FIG. 6B shows a perspective front view of a golfer using one embodiment of the method at the top of the backswing portion of a golf swing.
Figure 9B:
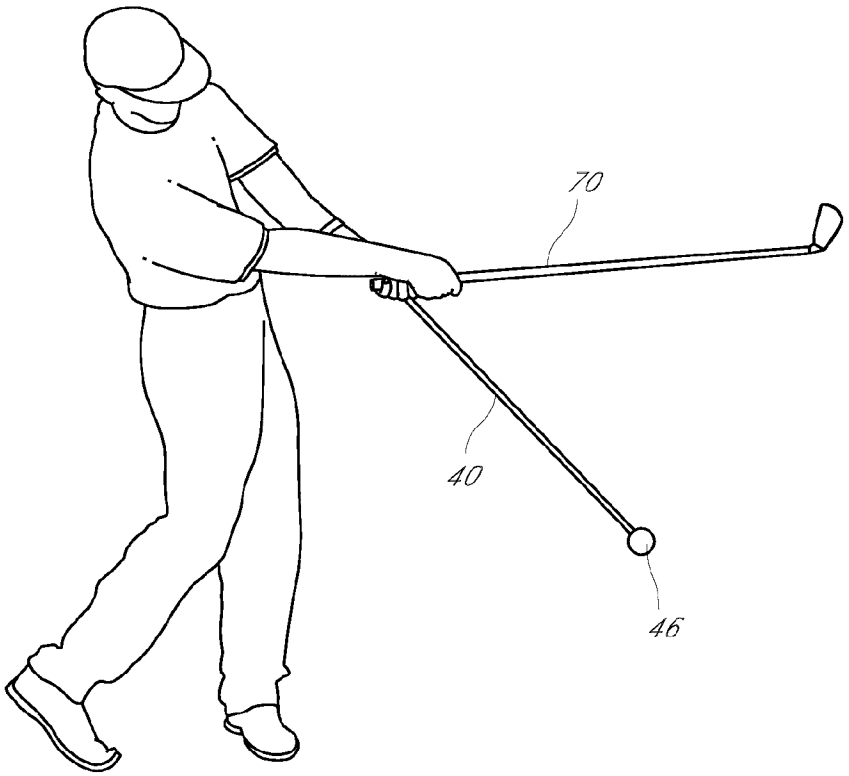
FIG. 9B shows a perspective front view of a golfer using one embodiment of the method during the follow-through portion of a golf swing.

In the embodiment depicted in FIG. 3B, the golfer is at the static address position wearing the device 30 on his left forearm and gripping a golf club 70. As is illustrated by FIGS. 4B, 5B and 6B, when the golfer moves the golf club 70 backwards through the backswing, the point of focus moves in a substantially circular pattern (in a clockwise direction as shown in the figures). Likewise, as seen in FIG. 9B, after the golfer reaches the top of the backswing, during the downswing and follow-through, the point of focus again moves in a substantially circular pattern (this time, however, in a counterclockwise direction as shown). In a preferred embodiment, the radius of the circular path of the point of focus is substantially constant. By concentrating on continuously moving the point of focus in such a circular manner, the golfer unintentionally keeps his or her shoulders and arms in motion during the entire swing sequence. In addition, since the target 46 defining a point of focus is in the golfer's sight of vision during the entire swing, the golfer is able to better visualize this circular motion. In one embodiment, the visible circular plane may enable the golfer to choose a particular circular pattern that optimizes his or her golf swing. Consequently, the golfer avoids any undesirable interruptions, resulting in a smoother swing and a more accurate and consistent golf shot. One reason for the smoother swing is that the point of focus is moved knowing that the point of focus will not itself contact anything during the movement. Thus, the golfer is able to shift his or her focus from a contact motion to a smoother non-contact motion. As discussed above, the execution of the golf shot is further improved by the mental benefits associated with focusing on moving the point of focus.

In other embodiments, movement of the point of focus in a circular pattern is particularly well suited for establishing and indicating proper tempo and rhythm during a bodily movement. For example, if a golfer's arms improperly slow down during a golf swing, the point of focus may wobble, and the user will be alerted.

Figure 3A:
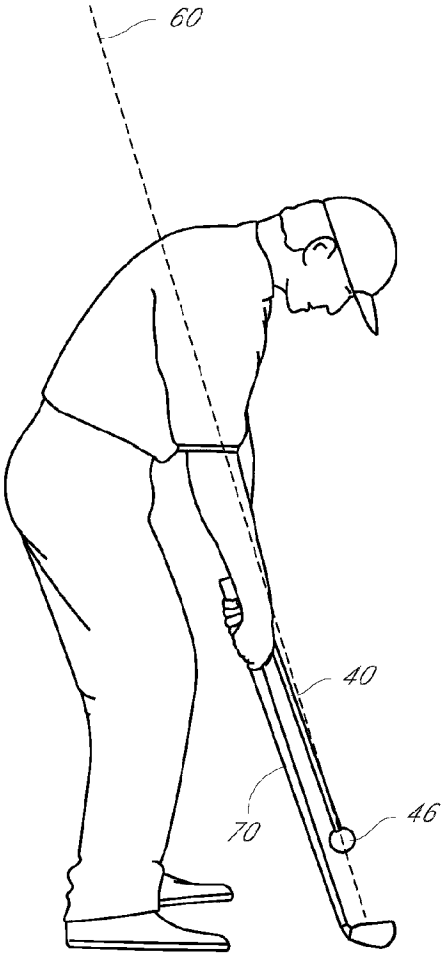
FIG. 3A shows a perspective side view of a golfer using one embodiment of the method at the initial address position of a golf swing.
Figure 4A:
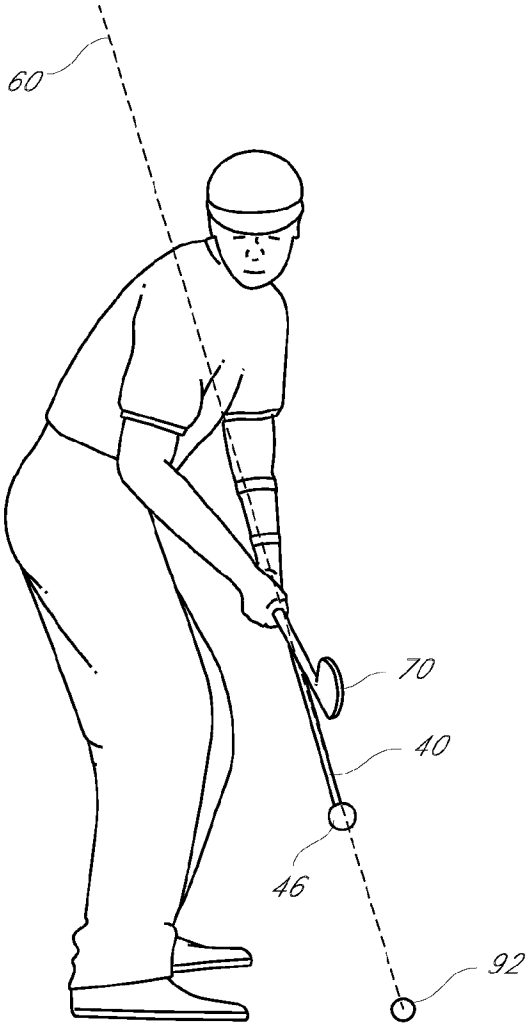
FIG. 4A shows a perspective side view of a golfer using one embodiment of the method during the backswing portion of a golf swing.
Figure 5A:
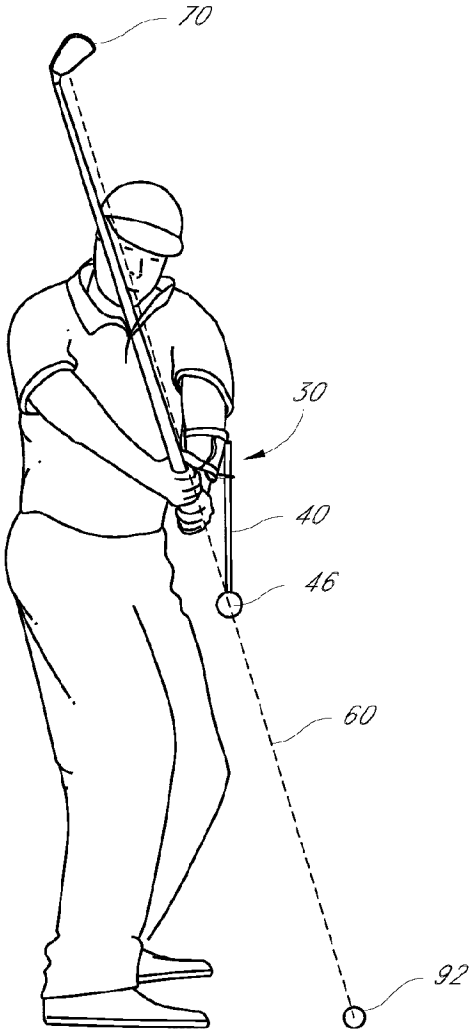
FIG. 5A shows a perspective side view of a golfer using one embodiment of the method during the backswing portion of a golf swing.
Figure 6A:
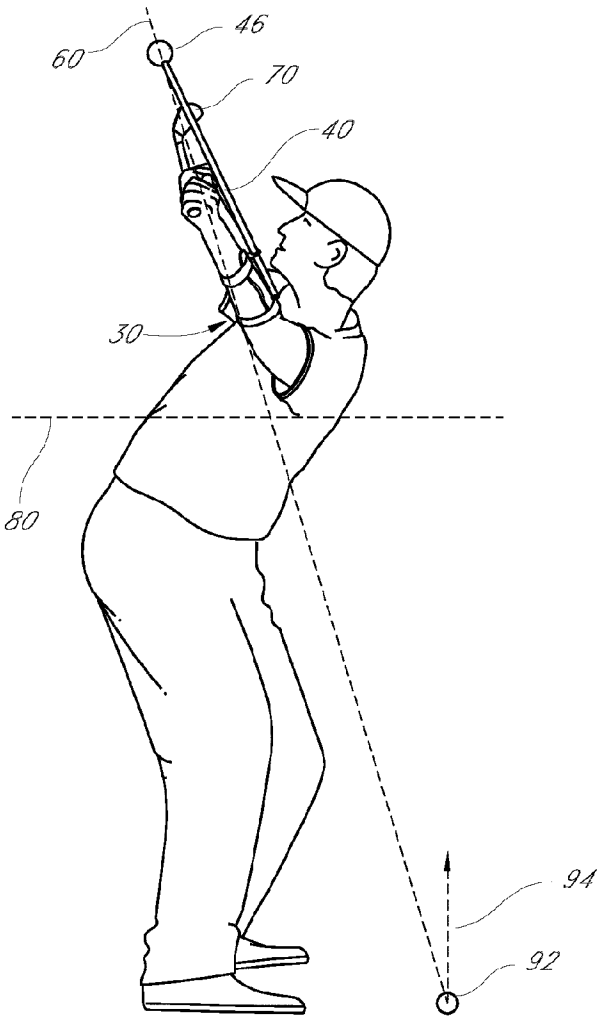
FIG. 6A shows a perspective side view of a golfer using one embodiment of the method at the top of the backswing portion of a golf swing.
Figure 8:
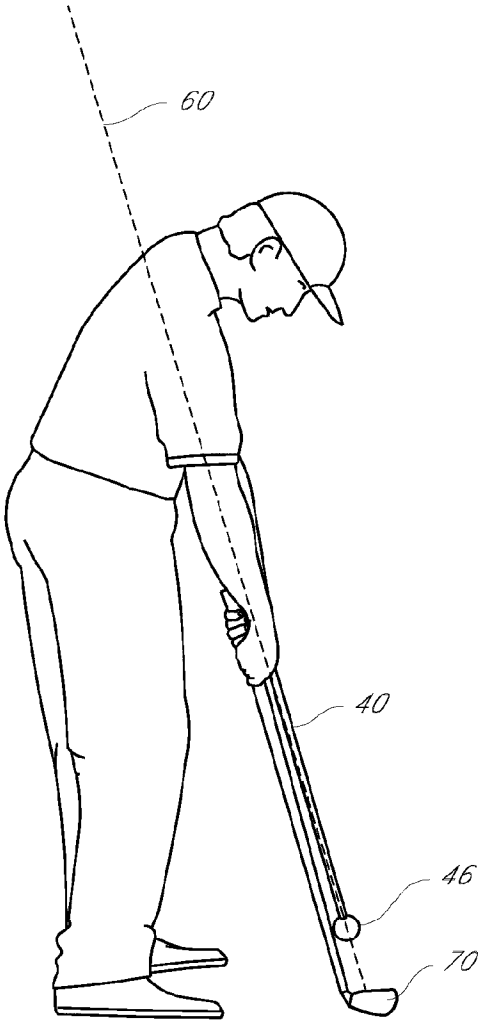
FIG. 8 shows a perspective side view of a golfer using one embodiment of the method during the downswing portion of a golf swing.
Figure 7:
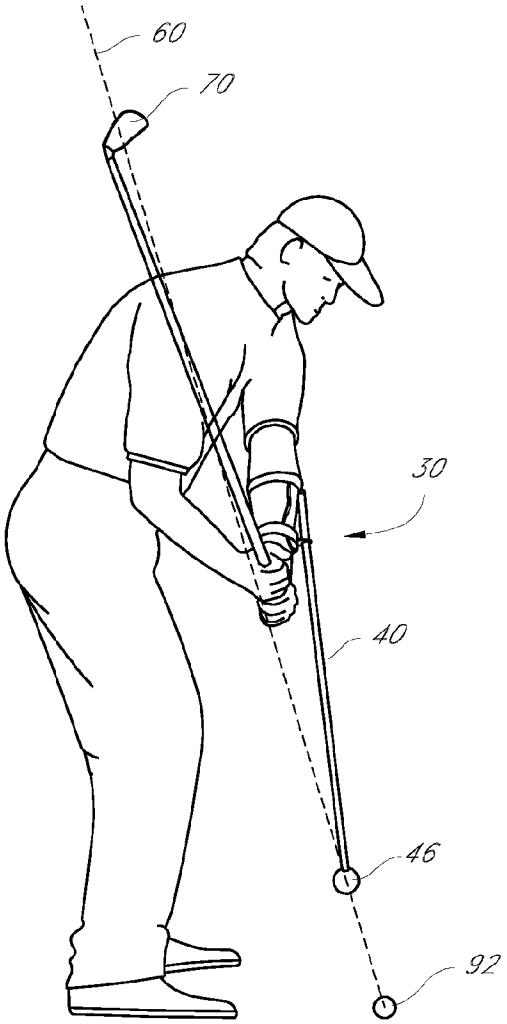
FIG. 7 shows a perspective side view of a golfer using one embodiment of the method during the downswing portion of a golf swing.
Figure 9A:
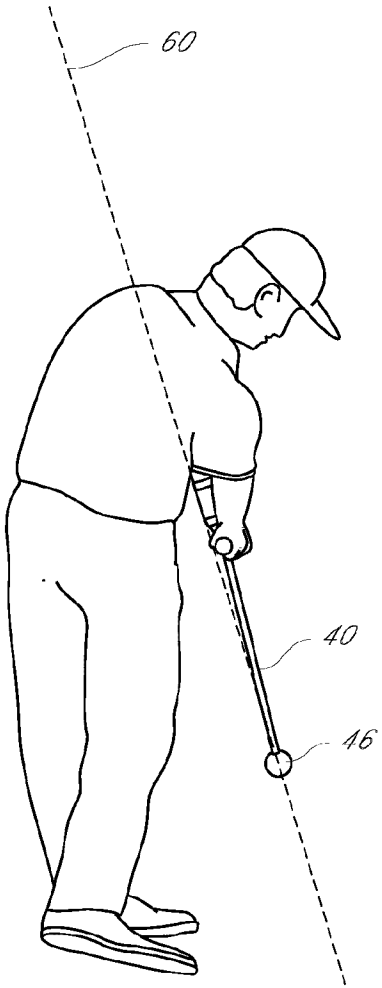
FIG. 9A shows a perspective side view of a golfer using one embodiment of the method during the follow-through portion of a golf swing.
Figure 10:
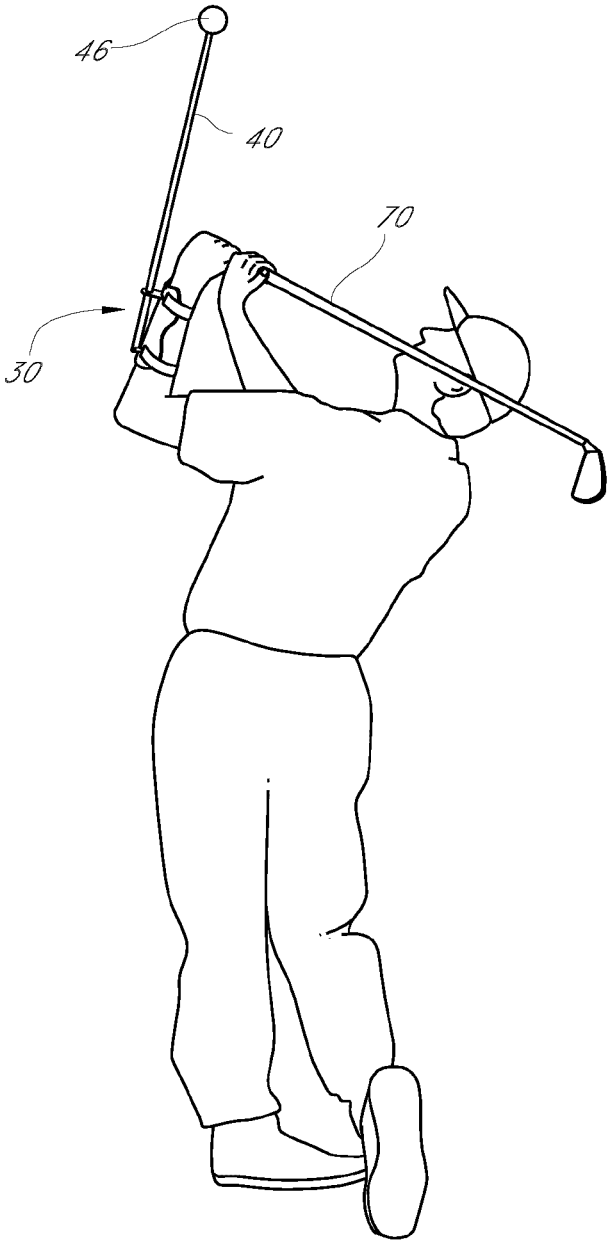
FIG. 10 shows a perspective view of a golfer using one embodiment of the method at the end of the follow-through portion of a golf swing.

In some embodiments, the point of focus may be substantially moved within a single plane. FIGS. 3A, 4A, 5A, 6A, 7, 8, 9A and 10 illustrate, in a time sequential manner, one embodiment of the method in use during the execution of a golf swing. A device 30 having a target 46 defining a point of focus is situated on the golfer's left forearm. FIG. 3A shows the golfer at the address position immediately prior to the commencement of his or her swing. FIGS. 4A, 5A and 6A show a chronological sequence of movements during the golfer's backswing, as seen by someone standing behind the golfer and along the target line of the ball. As can be seen from these figures, the point of focus desirably moves substantially within plane 60. Further, the point of focus remains substantially within this plane 60 during the downswing and follow-through portions of the swing, as illustrated in FIGS. 7, 8 and 9A.

In some embodiments, the method requires the golfer to execute a minimum backswing in preparation for the subsequent downswing and follow-through. In one embodiment, the golfer must carry out the backswing to at least an extent such that the point of focus 46 passes a minimum threshold level 80 along plane 60, as indicated in FIGS. 6A and 6B. In other words, if FIG. 6B is viewed as a clock (with the golfer's shoulders representing the center of the clock and the elongated member 40 representing the hands of the clock), the elongated member 40 desirably reaches "9 o'clock" (represented by line 80) to ensure proper arm lift. In a preferred embodiment, in order to ensure proper shoulder turn, the golfer should perform a backswing so that the elongated shaft 40 is substantially parallel to the target line 94 of the golf ball 92, as shown in FIG. 6A. In some embodiments, once the golfer has reached the top of his or her backswing, the downswing may be performed by simply moving the point of focus directly toward the target (the golf ball). In one embodiment, the golfer is required to keep his or her wrist (left wrist as shown in the figures) flat and cocked as the point of focus is moved toward the target. As a result, the face of the golf club will follow the point of focus directly to the target and the golfer's left wrist will unhinge naturally. A plane 90 (represented by a cross-hatched pattern in FIG. 6B), which is formed by the elongated member 40 of the device 30 and the golfer's club 70, will also necessarily pass through the intended target if the golfer moves the point of focus to the target during the downswing. As the golfer moves the point of focus towards the intended target, the club will generally trace the same inclined circular plane to the target. In a preferred embodiment, as shown in the figures, the golfer will attempt to maintain the point of focus and the club 70 within an ideal plane 60 during all phases of the golf swing, including the backswing, downswing and follow-through. However, in some embodiments, the golfer may make the most of his or her swing, regardless of the backswing, if he or she simply directs the point of focus towards the golf ball during the downswing. Consequently, the golf club will be guided directly to the golf ball, thereby maximizing the outcome for that particular swing. This is particularly well-suited for beginner and intermediate-level golfers who may find it difficult to swing their clubs within a desired plane. As golfers gain more experience, they may begin to focus on making other adjustments (e.g., backswing, arm lift, shoulder turn, etc.) in order to further improve their overall golf swing.

Figure 11:
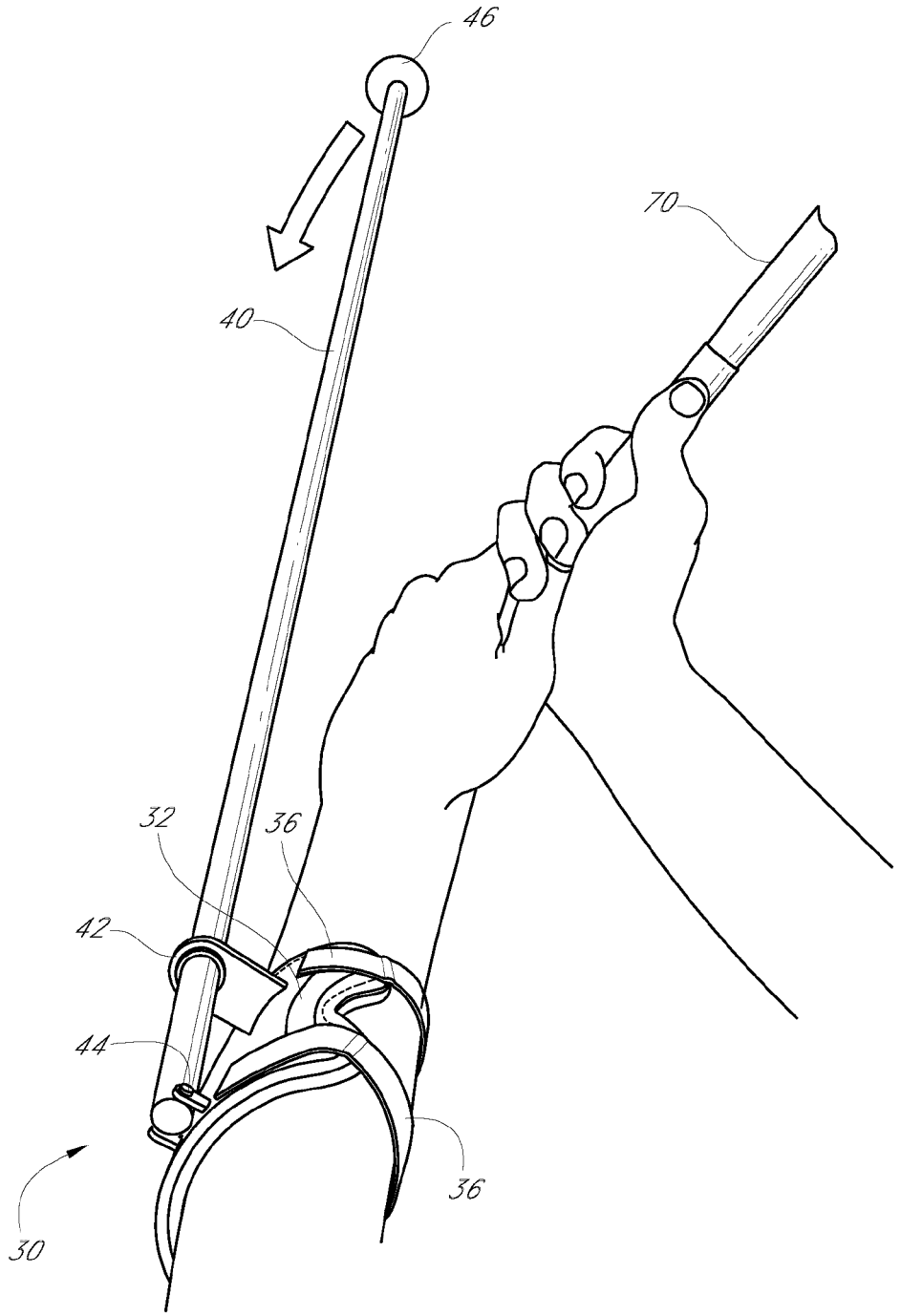
FIG. 11 shows a view from the golfer's perspective of a golfer using one embodiment of the method immediately prior to the commencement of the downswing.

FIG. 11 illustrates the view of a golfer using one embodiment of the method. Specifically, the golfer is looking at the point of focus immediately before starting the downswing. At this moment in time, in one embodiment, the golfer should have properly rotated his or her shoulders and raised his or her arms. In a preferred embodiment, the golfer must then attempt to move the point of focus directly towards the target (e.g., the golf ball).

The point of focus significantly enhances the golfer's ability to visualize this plane 90 throughout the swing by providing a secondary reference point that the golfer would not otherwise have. In one embodiment, the plane 90 may match the golfer's swing plane in order to maximize the swing, frequently resulting in a pure shot. In some embodiments, golfers use this secondary reference point to better determine where they are in the golf swing process and to determine if they are within a desired plane of movement. In addition, it provides golfers with a way to self-evaluate their golf swing.

Advantageously, in its preferred embodiments, the device 30 is not gripped by the hands of the user. The device desirably can be used while the golfer is swinging a golf club, so that when the golfer is on the course, the golfer will be able to recreate the swing movement more easily, rather than relying on a device which must be set aside before swinging with a golf club. Similarly, the device preferably is not connected to a golf club, so that its movement is not tied directly to the movement of the small muscles of the hand and/or wrist and so that the golfer does not become overwhelmed by stress in attempting to precisely position the golf club during each segment of the golf swing. By focusing on the continuous movement of the point of focus substantially within a plane, it is believed that the method assists in achieving the proper sequential release of the user's joints during the execution of a movement such as a golf swing. For example, in one embodiment, if the golfer moves the target 46 defining a point of focus directly toward the target on the downswing, as discussed above, the elongated member 40 of a device 30 may be used as an indicator of the proper direction of movement for uncocking the golfer's wrists. Thus, in one embodiment, if the golfer's wrists are properly positioned during the downswing, the movement of the target 46 defining a point of focus toward the target will naturally sequence the release of golfer's wrists and other joints as the swing transitions into follow-through phase.

In some embodiments, the user may utilize the point of focus as an alignment tool in relation to a bodily movement. For example, in some embodiments, the point of focus may indicate the extent to which a golfer's shoulders turn during the backswing. Thus, in one embodiment, a golfer may utilize the point of focus as a guide to develop proper shoulder rotation during the backswing. In one embodiment, the golfer may prevent over-rotation by terminating his or her backswing when the point of focus reaches a designated location in space or when the elongated member 40 of the device 30 is substantially parallel to the target line of the golf ball. As mentioned above, in some embodiments, this will also ensure that the golfer has properly situated himself or herself in preparation for the downswing portion of the swing. For example, the golfer may use the device to ensure that he or she has attained proper arm lift and shoulder turn.

Figure 12A:
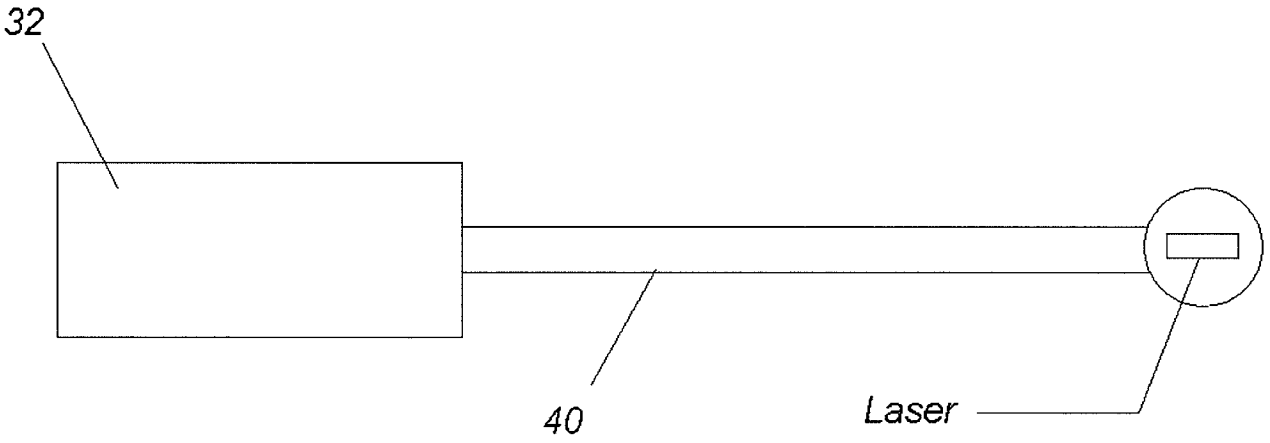
FIG. 12A illustrates a schematic view of one embodiment of a device comprising a laser or other light emitting source.

In some embodiments, a laser may be added to the point of focus in order to project the position of the point of focus on the ground or on a wall (see, e.g., FIG. 12A). This would make it easier for a user to determine the exact location (e.g., horizontal position) of a point of focus during the execution of a bodily movement. For example, in one embodiment, a golfer, while focusing on continuously moving a point of focus during his or her swing, would be able to detect the exact position of the point of focus relative to his or her body. This is especially helpful during the latter stages of the backswing and follow-through of the golf swing when shoulder rotation makes it more difficult to determine how far behind the golfer the point of focus has moved.

In some embodiments, the point of focus and/or the elongated member may be weighted. This would alter the forces that the user feels during a particular bodily movement. For example, in one embodiment of the device 30 shown in FIGS. 1 and 2, the target 46 defining a point of focus and/or the elongated member 40 may be weighted to alter the feel of the golf swing. In one embodiment, the modified feel of the target 46 defining a point of focus and/or the elongated member 40 may make it easier for the golfer to recognize discontinuous movement of the target 46 defining a point of focus throughout a complete circular movement, over-rotation of the shoulders, improper tempo or some other deficiency that may affect the golf swing.

Figure 12B:
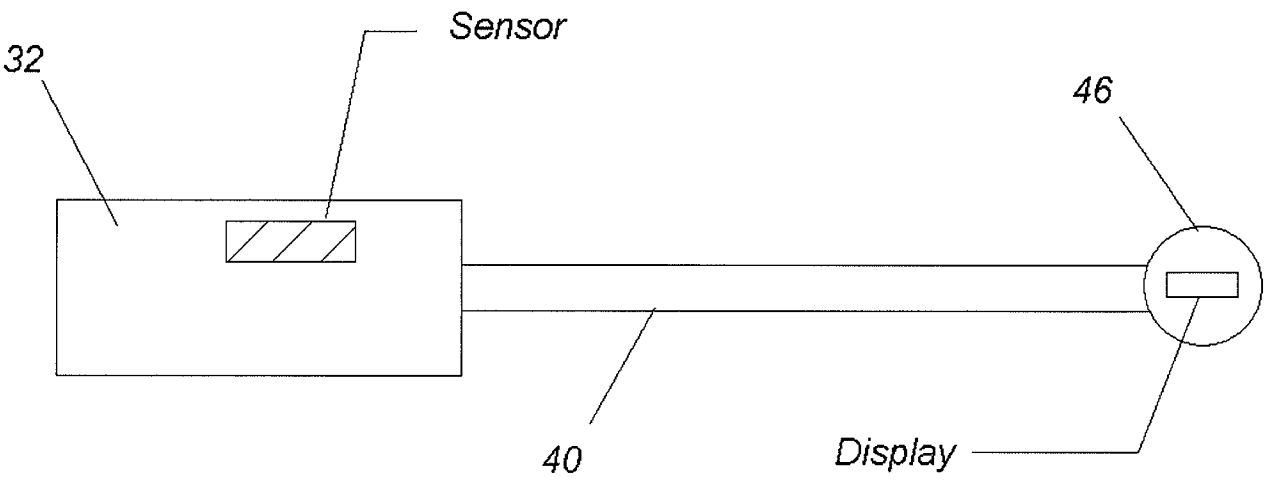
FIG. 12B illustrates a schematic view of another embodiment of a device used to establish a point of focus.

In some embodiments, a method may incorporate biofeedback technology. For example, in one embodiment, a device 30 may be equipped with heart rate and/or blood pressure sensing features (see, e.g., FIG. 12B). Those of skill in the art recognize that other real-time data regarding the user may also be measured. In one embodiment, the heart rate and/or blood pressure measurements may also be revealed to the user. In a preferred embodiment, such data are indicated to the user via a display situated on the point of focus or elsewhere in the user's light of sight, thus allowing the user to be aware of this information during the execution of the bodily movement (see, e.g., FIG. 12B). In other embodiments, the point of focus may change colors to indicate changes in the information being measured. For example, the point of focus may become more red as the user's heart rate and/or blood pressure increase. This will enable the user to better assess his or her condition prior to, during and after a particular movement. Of course, those of skill in the art will recognize that the exact manner in which such information is provided to the user is not important, so long as the user is made aware of the real-time information being measured.

In some embodiments, information related to the point of focus or any other device or part of a device may be measured using the appropriate sensing means. For example, in some embodiments, the speed at which the point of focus is moved, the exact location of the point of focus at various points during the movement, the torque exerted on the elongated member during the swing and/or the like may be measured.

In another embodiment, any information measured during the course of the movement (e.g., related to the user's body, the physical movement of the point of focus or otherwise, etc.) may be instantaneously indicated and/or stored for later extraction (e.g., download). In one embodiment, such extracted information can be later displayed on a monitor (e.g., computer screen).

In some embodiments, the method may be useful to enhance a television broadcast or some other type of filmed program involving a sporting event. For example, in one embodiment, a device having a point of focus may be worn by one or more golfers during a televised golf tournament. Consequently, television personnel would be able to analyze different aspects of a participating golfer's swing. For example, in one embodiment, the path taken by the point of focus during the swing could be traced and visually displayed on the television to evaluate key swing characteristics including, but not limited to, the circularity of the swing, planes generated by the golf club and the point of focus, tempo, shoulder rotation and the like.

Embodiments of the device 30 shown in FIG. 1 may be thought of as sporting goods equipment capable of being utilized outside the training context. For example, in some embodiments, the device 30 may be used by a golfer on the golf course, while he or she plays an actual round of golf, either recreationally or competitively.

Despite the fact that the embodiments herein have been primarily related generally to the sport of golf, and more specifically to a golf swing, those of skill in the art will recognize that the disclosed methods and devices are equally applicable to other golfing movements (e.g., putting or chipping) and even to other sports, especially those that involve the contact or displacement of objects using circular bodily movements (e.g., tennis, soccer, baseball, basketball, etc.). For example, in shooting a basketball, the back movement could be at least a portion of cocking the basketball, the forward movement could desirably be from the extreme back of the back movement to the release of contact with the basketball and the follow-through can be from the end of the forward movement to completion of the stroke.

Although certain embodiments and examples have been described herein, it will be understood by those skilled in the art that many aspects of the methods and devices shown and described in the present disclosure may be differently combined and/or modified to form still further embodiments. Additionally, it will be recognized that the methods described herein may be practiced using any device suitable for performing the recited steps. Such alternative embodiments and/or uses of the methods and devices described above and obvious modifications and equivalents thereof are intended to be within the scope of the present disclosure. Thus, it is intended that the scope of the present invention should not be limited by the particular embodiments described above, but should be determined by a fair reading of the claims that follow.

What is claimed is:

1. A method of improving the ability of a user to move an object as a result of athletic movement that relates to striking an item, comprising:

securing a device to one of (1) a forearm of the user between a wrist and an elbow, (2) an upper arm of the user between an elbow and a shoulder and (3) an upper leg of the user between a knee and a hip, said device defining a point of focus, wherein the device is configured to secure to an attachment site of the user;

wherein the device positions the point of focus that extends longitudinally with respect to said one of the forearm, the upper arm or the upper leg of the user beyond the attachment site and beyond the hand, elbow or knee, respectively, of the user at a location which is substantially constant with respect to the attachment site of the user; and moving the point of focus through at least a portion of a forward movement and at least a portion of a follow-though movement following a point of contact so that the point of focus is substantially continuously within the field of vision of the user, wherein the point of focus does not contact the item during a movement sequence.

2. The method of claim 1, wherein the device is configured to secure to the user's forearm or upper arm.

3. A training device used in performing an athletic movement relating to striking an item, comprising:

a base configured to secure to an attachment site, wherein said attachment site comprises one of a forearm, an upper arm and an upper leg of a user;

at least one fastener to releasably secure the base to the attachment site of the user; and a point of focus extending longitudinally with respect to the forearm, the upper arm or the upper leg of the user beyond the attachment site and beyond the hand, elbow or knee, respectively, of the user at a location which is substantially constant with respect to the attachment site of the user;

wherein the point of focus is not configured to contact the item during a movement sequence.

4. The device of claim 3, wherein the device is configured to secure to the user's arm or upper leg.

5. The device of claim 3, further comprising a laser attached to the point of focus, wherein said laser is configured to project a position of the point of focus on a ground or wall surface.

6. The device of claim 3, wherein the point of focus is weighted to alter a feel of performing an athletic movement.

* * * * *